US005694913A

United States Patent [19]

Parrott

[11] Patent Number: 5,694,913

[45] Date of Patent: Dec. 9, 1997

[54] BIRD THROWING APPARATUS

[76] Inventor: John K. Parrott, 2815 Hwy. 139, Monroe, La. 71203

[21] Appl. No.: 376,755

[22] Filed: Jan. 23, 1995

[51] Int. Cl.[6] ..... F41B 3/02

[52] U.S. Cl. ..... 124/17; 124/21; 124/35.1

[58] Field of Search ..... 124/16, 17, 20.1, 124/21, 35.1

[56] References Cited

U.S. PATENT DOCUMENTS

| | | | |
|---|---|---|---|
| 2,282,315 | 5/1942 | Adams | 124/17 |
| 3,277,878 | 10/1966 | Pankratz | 124/20.1 |
| 4,050,438 | 9/1977 | Pfotenhauer | 124/20.1 |
| 5,303,695 | 4/1994 | Shopsowitz | 124/17 |
| 5,398,665 | 3/1995 | Carlson | 124/17 |
| 5,431,145 | 7/1995 | Strait et al. | 124/17 |

FOREIGN PATENT DOCUMENTS

| | | | |
|---|---|---|---|
| 632976 | 6/1936 | Germany | 124/17 |

*Primary Examiner*—John A. Ricci
*Attorney, Agent, or Firm*—John M. Harrison

[57] ABSTRACT

A bird throwing apparatus for training bird dogs such as Labrador Retrievers, Setters and other dogs in the art of retrieving shot birds such as quail, dove and in particular, ducks. In a preferred embodiment the bird throwing apparatus is characterized by a frame fitted with pulleys, around which are wound four lengths of surgical tubing. One end of each of the lengths of surgical tubing is attached to a bird cradle for receiving dead birds and the other ends are attached to the apparatus frame, such that the bird cradle is suspended in the center of the frame at the release end of the frame when the surgical tubing is relaxed, and in cocked position at the opposite end of the frame at a trigger mechanism, when the surgical tubing is tensioned. A frame support is attached to the frame to facilitate positioning the frame in a selected angular orientation with respect to the horizontal and allowing release of a bird from the bird cradle at a selected angle by operation of the trigger mechanism, which releases the tension in the surgical tubing. In a preferred embodiment of the invention the frame folds into a substantially flat configuration for shipping or storage. In another preferred embodiment a starter pistol is attached the frame and a lanyard is stretched between the starter pistol trigger and the bird cradle to facilitate firing of the starter pistol when the bird cradle is released and a bird or birds are thrown from the bird throwing apparatus.

13 Claims, 3 Drawing Sheets

BIRD THROWING APPARATUS

BACKGROUND OF THE INVENTION

1. Field of the Invention

This invention relates to bird retrieval training devices for bird dogs and more particularly, to a bird throwing apparatus which may either be designed for folding or for rigid application to throw a bird or birds such as a duck, dove, quail or the like through a selected trajectory for training a bird dog such as a Labrador Retriever to retrieve shot birds. In one embodiment, the bird throwing apparatus is characterized by a release frame which is pivotally attached to a pair of stiffening tubing that converge from the release frame to a trigger mechanism designed to releasably engage a bird cradle against the bias of multiple lengths of surgical tubing stretched around pulleys attached to the release frame. Release of the bird cradle sends a dead bird or birds such as ducks, quail, dove or the like from the bird throwing apparatus through a selected trajectory, for training the bird dog. In another embodiment, the release frame is fixed to the stiffening tubing and in both embodiments, a frame support may be provided on both the folding and rigid variations of the bird throwing apparatus to facilitate raising or lowering the bird throwing apparatus to a selected angle with respect to the horizontal, thus facilitating throwing of the bird(s) from the bird throwing apparatus through a selected trajectory. In yet another preferred embodiment, a starter pistol may be attached to the bird throwing apparatus and a trigger lanyard having one end attached to the trigger end of the starter pistol and the other end attached to the bird cradle, facilitates firing of the starter pistol simultaneously with throwing a bird from the bird throwing apparatus to simulate shooting of the bird(s) as the bird(s) drops from the selected trajectory to the ground.

One of the essential elements in the training of bird dogs to retrieve shot birds, is the throwing or tossing of dead birds such as ducks, dove, quail and the like and training the dog to retrieve the bird. A problem which is inherent in such training exercises is the limited distance and height which can be obtained by the arm in manually throwing a bird to simulate shooting of the bird from the air.

2. Description of the Prior Art

Various devices have been developed for throwing, tossing or slinging dead birds such as ducks, doves, quail and the like into the air to simulate shooting of the bird in order to train bird dogs to retrieve birds. Typical of these devices is the "Wing Launcher" detailed in the November, 1994, issue of "Retriever Field Trial News" at page 53. The "Wing Launcher" is designed very much like a slingshot and includes a U-shaped member vertically supported by a tripod and fitted with a pouch which is connected to the U-shaped member by means of surgical tubing or rubber bands of selected strength. A dead bird such as a duck, quail, dove or the like is placed in the pouch, the rubber bands or surgical tubing stretched to the desired extent to achieve the required distance and, to some extent, a desired trajectory, and the pouch released, to propel the bird from the device and simulate shooting of the bird in mid-air.

It is an object of this invention to provide a new and improved bird throwing apparatus which is designed to throw a wide variety of dead birds such as ducks, dove, quail and the like, upwardly in a desired trajectory for a significant distance to simulate shooting of the bird and train a bird dog to retrieve the bird.

Another object of the invention is to provide a bird throwing apparatus for propelling dead birds upwardly in a selected trajectory, which apparatus is characterized by a release frame pivotally or fixedly attached to a pair of downwardly-extending and converging stiffening tubing. The stiffening tubing converge at a trigger mechanism to facilitate stretching four lengths of surgical tubing extending around pulleys attached to the release frame and attached to a bird cradle and selectively, either manually or remotely releasing the bird cradle with a bird or birds therein by operation of the trigger mechanism. This action facilitates travel of the bird(s) from the apparatus, along the selected trajectory and simulates shooting of the bird(s) to train a bird dog.

Still another object of the invention is to provide a bird throwing apparatus which is designed for mounting at a selected angle with respect to the horizontal and includes a frame which receives multiple lengths of surgical tubing stretched around pulleys attached to the upper end of the frame and connected to a bird cradle. The bird cradle can be engaged by a trigger mechanism when the surgical tubing is stretched, with a bird or birds placed in the bird cradle and the trigger mechanism then operated either manually or remotely to release the bird cradle and eject the bird(s) into the air along the selected trajectory, depending upon the angle of the bird throwing apparatus with respect to the ground.

Yet another object of this invention is to provide a bird throwing apparatus which is characterized by a release frame that is pivotally attached to the ends of a pair of stiffening tubing which converge downwardly to a trigger mechanism. Surgical tubing extend around corresponding pulleys attached to the release frame and connect to a flexible bird cradle and removably to the stiffening tubing frame. A support is pivotally attached to the stiffening tubing for orienting the release frame and stiffening tubing at a selected angle with respect to the ground, wherein a bird is placed in the bird cradle and released in a selected trajectory determined by the release angle, by operation of the trigger mechanism and the tension in the surgical tubing.

A still further object of this invention is to provide a bird throwing apparatus which is characterized by a rigid release frame and stiffening tubing combination, which stiffening tubing converges from the release frame to a trigger mechanism. Pulleys are provided on the release frame for receiving multiple lengths of surgical tubing, one end of each of which is removably attached by means of rings to the stiffening tubing and the other ends extended through the pulleys and permanently secured to a flexible bird cradle. A frame support is rigidly or adjustably attached to the stiffening tubing to facilitate orienting the release frame and stiffening tubing at a selected angle with respect to the horizontal and throwing a bird placed in the bird cradle at the selected trajectory from the bird throwing apparatus responsive to operation of the trigger mechanism and the release of tension in the surgical tubing.

SUMMARY OF THE INVENTION

These and other objects of the invention are provided in a new and improved bird throwing apparatus which is capable of throwing a dead bird or birds such as ducks, dove, quail or the like through a selected trajectory for training bird dogs. The bird throwing apparatus is characterized by a release frame which is pivotally or fixedly attached to a pair of downwardly-extending and converging stiffening tubing that terminate at a trigger mechanism. The release frame is fitted with four spaced pulleys which receive separate lengths of surgical tubing, one end of which tubing is removably attached by means of rings to hooks on the stiffening tubing and the other ends fixed to a flexible bird cradle located within the bird throwing apparatus and engaged by the trigger mechanism when the surgical tubing is tensioned. A bird or birds placed in the bird cradle is released into a selected trajectory, depending upon the angle of orientation of the bird throwing apparatus with respect to the ground, responsive to manipulation of a trigger cable or a radio transmitter to activate the trigger mechanism and simulate shooting of the bird or birds and facilitate training of the bird dog.

The invention will be better understood by reference to the accompanying drawings, wherein.

DESCRIPTION OF THE PREFERRED EMBODIMENTS

Figure 1:
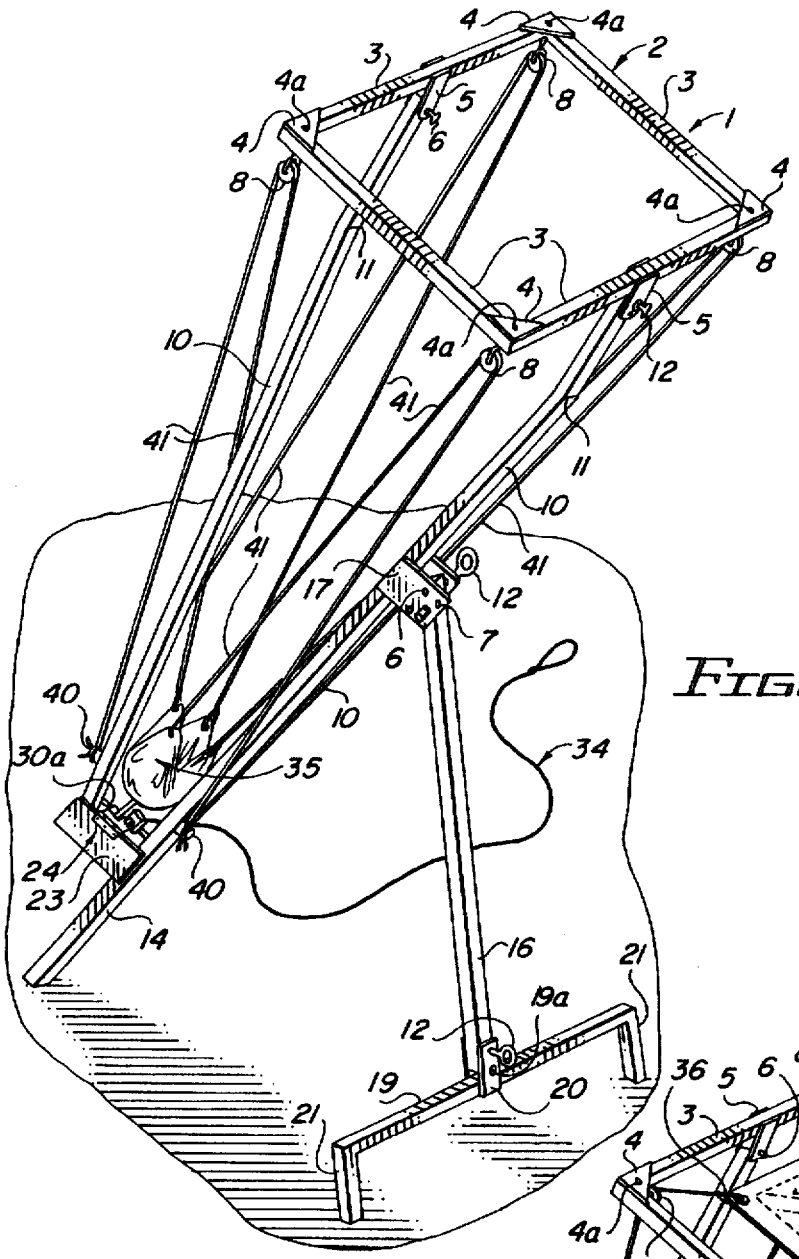
FIG. 1 is a perspective view of a preferred embodiment of the bird throwing apparatus of this invention in cocked configuration.
Figure 2:
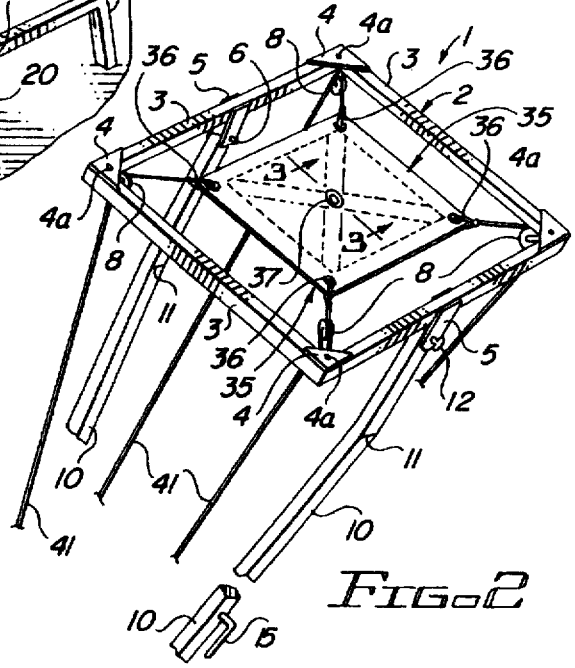
FIG. 2 is a perspective view of the upper portion of the bird throwing apparatus illustrated in FIG. 1, with the bird throwing apparatus illustrated in release configuration.

Referring initially to FIGS. 1 and 2 of the drawings, the bird throwing apparatus of this invention is generally illustrated by reference numeral 1. In a preferred embodiment the bird throwing apparatus 1 is characterized by a release frame 2, constructed of release frame tubing 3 which is welded together to define a square or rectangular opening and is stiffened by gussets 4, fitted with gusset eye bolts 4*a*, the eyes of which project downwardly, as illustrated. A pair of bifurcated frame pivot brackets 5 are welded or otherwise attached to oppositely-disposed and parallel pairs of the release frame tubing 3 and each of the frame pivot brackets 5 is fitted with an opening for receiving a pivot bracket pin 6. A tubing pulley 8 is suspended from each of the gusset eye bolts 4*a*, which are threaded into or otherwise attached to the gussets 4 and a pair of stiffening tubing 10 project between the parallel legs of the bifurcated frame pivot brackets 5 and are provided with an opening (not illustrated) that registers with the openings in the frame pivot brackets 5, to receive a removable bracket pin 12 and connect the release frame 2 of the bird throwing apparatus 1 to the stiffening tubing 10, as illustrated. The stiffening tubing 10 extends from the bend 11 downwardly to a release hinge mount 23, as illustrated in FIG. 1. One of the leg segments 13 continues past the release mount 23 to define a stabilizing segment 14 that contacts the ground to stabilize the stiffening tubing 10 in the functional configuration illustrated in FIG. 1. One end of a frame support 16 is pivotally attached to a frame support pivot bracket 17, rigidly welded or otherwise attached to one of the stiffening tubing 10 by means of a pivot bracket pin 6, as further illustrated in FIG. 1. Bracket openings 7 are provided in the frame support pivot bracket 17 to facilitate adjustment of the frame support 16 and thus, the angle of the release frame 2 and stiffening tubing 10 with respect to the horizontal. A bracket pin 12 is inserted in the respective bracket openings 7 to determine this angle. The opposite end of the frame support 16 is fitted in a bifurcated foot pivot bracket 20, mounted on a horizontally-oriented support foot 19, having foot projections 21 at each end, for engaging the ground or other supporting surface. The frame support 16 pivots on a foot pivot pin 19*a* and is secured by means of another bracket pin 12, which extends through the aligned bracket opening 7 and frame support opening 22. Accordingly, it will be appreciated from a consideration of FIG. 1 that the foot projections 21 are spaced from each other and from the downwardly-extending stabilizing segment 14 of the stiffening tubing 10, to support the bird throwing apparatus 1 in a selected angular configuration with respect to the horizontal, for purposes which will be further hereinafter described.

Figure 9:
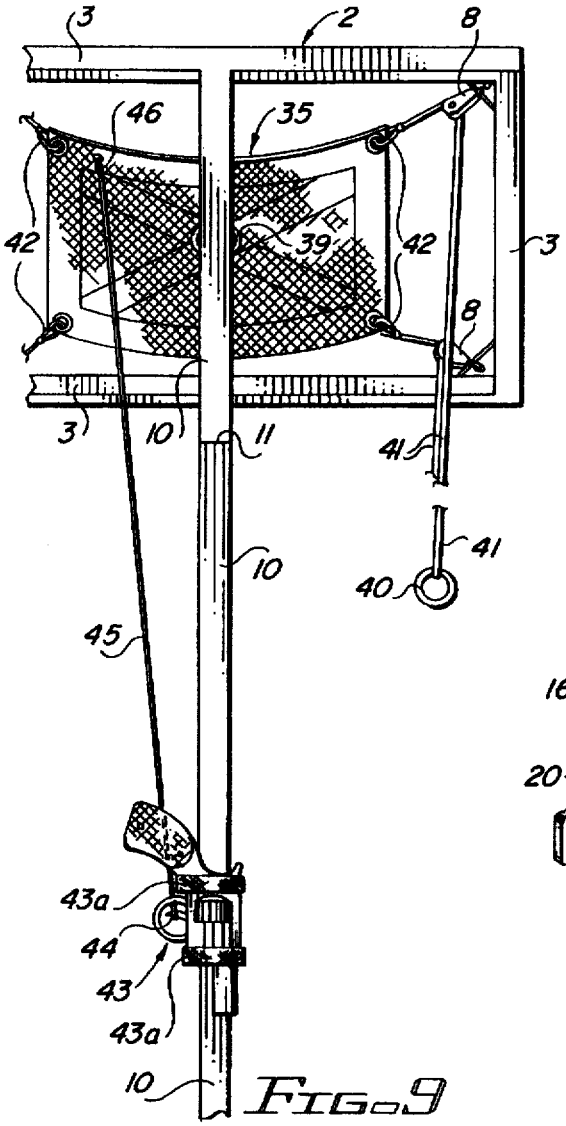
FIG. 9 is a front view, partially in section, of the bird throwing apparatus illustrated in FIG. 2, more particularly illustrating a starter pistol and pistol lanyard system for simulating firing of a shotgun when a bird ms shot and the bird throwing apparatus is used.
Figure 9A:
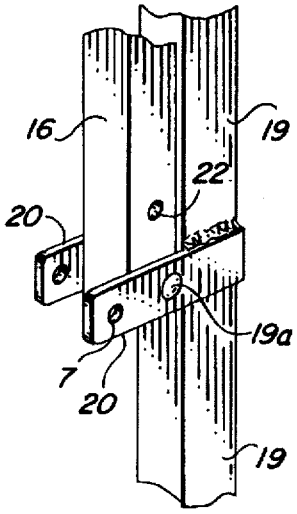
FIG. 9A is an enlarged perspective view of a foot pivot bracket which connects the frame support element to the support foot element of the bird throwing apparatus, with the support foot in folded configuration.
Figure 9B:
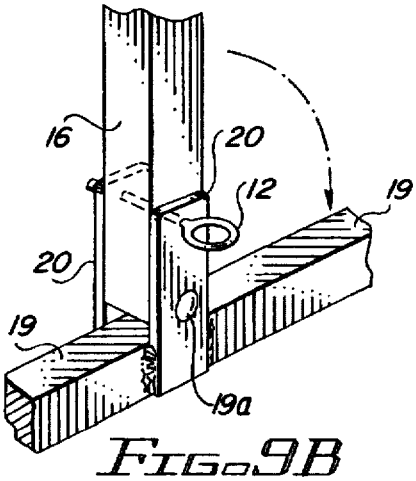
FIG. 9B is a perspective view of the foot pivot bracket, frame support and support foot elements of the bird throwing apparatus, more particularly illustrating deployment of the support foot element in functional, operational configuration.

As further illustrated in FIGS. 1, 2 and 9 and initially to FIGS. 2 and 9 of the drawings, a flexible bird cradle 35 is suspended in the opening defined by the release frame 2, by means of four lengths of surgical tubing 41. One end of each length of surgical tubing 41 is attached to each corner of the bird cradle 35 by means of cradle grommets 36, more particularly illustrated in FIG. 9 and the other ends of the surgical tubing 41 extend through the respective tubing pulleys 8 and project downwardly between the stiffening tubing 10. The surgical tubing 41 terminate in fixed orientation on tubing mount hooks 15, by means of attached tubing rings 40, when the bird throwing appartus 1 is oriented in the cocked configuration illustrated in FIG. 1. Accordingly, it will be appreciated that surgical tubing 41 can be tensioned by initially removing the tubing rings 40 from each of the respective tubing mount hooks 15 and allowing the bird cradle 35 to be lowered into the position illustrated in FIG. 1, where it is engaged with the release hinge 24 in the apparatus trigger mechanism, as hereinafter further described. Subsequently, each of the surgical tubings 41 are stretched around the corresponding tubing pulleys 8 and the tubing rings are engaged with the respective tubing mount hooks 15, to position the bird throwing apparatus 1 into the cocked, throwing configuration illustrated in FIG. 1. After a bird has been thrown from the bird cradle 35 by manipulating the trigger mechanism as hereinafter described, the bird throwing apparatus 1 is in the release configuration illustrated in FIG. 2.

Figure 3:
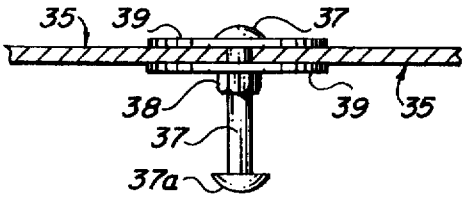
FIG. 3 is a sectional view taken along line 3—3 of the bird cradle, more particularly illustrating a preferred engaging bolt for engaging the trigger mechanism of the bird throwing apparatus when the bird throwing apparatus is in the cocked configuration illustrated in FIG. 1.
Figure 4:
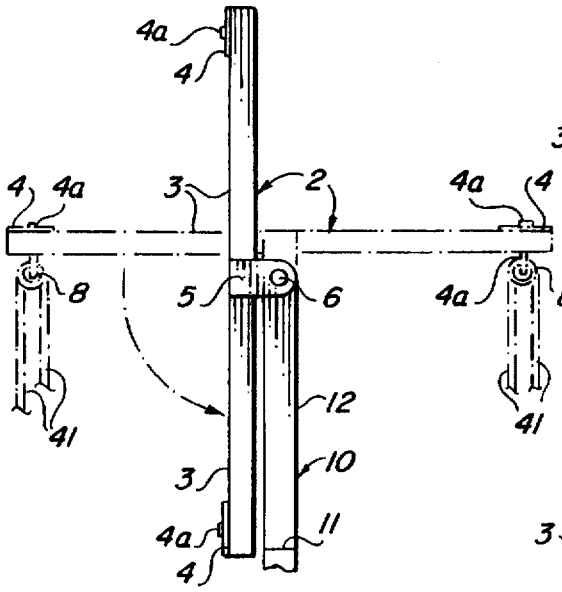
FIG. 4 is a front view of the release frame element of the bird throwing apparatus, more particularly illustrating a preferred pivoting and folding technique for selectively configuring the bird throwing apparatus in operational and folded configuration.
Figure 5:
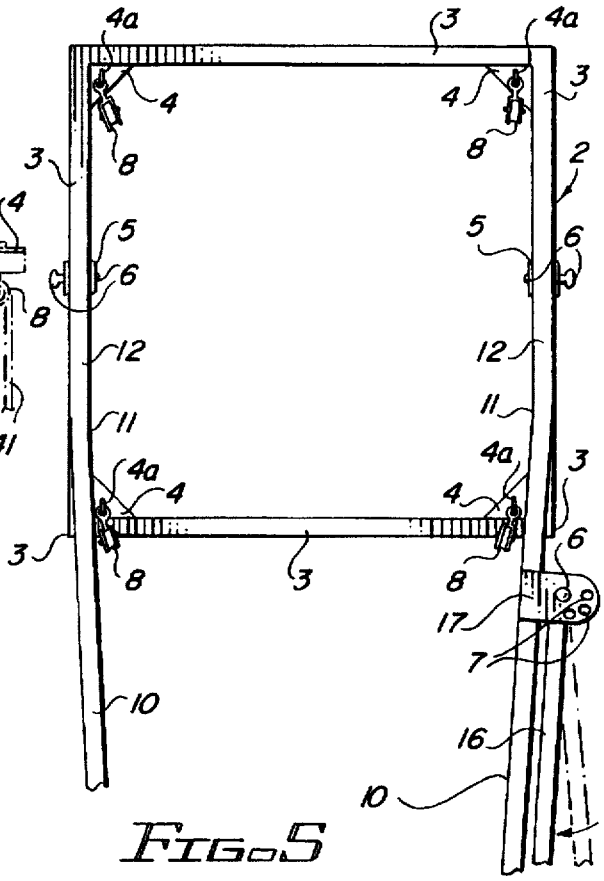
FIG. 5 is a side view of the bird throwing apparatus illustrated in FIG. 1, more particularly illustrating the folding configuration of the release frame and frame support elements of the apparatus illustrated in FIG. 4.
Figure 6:
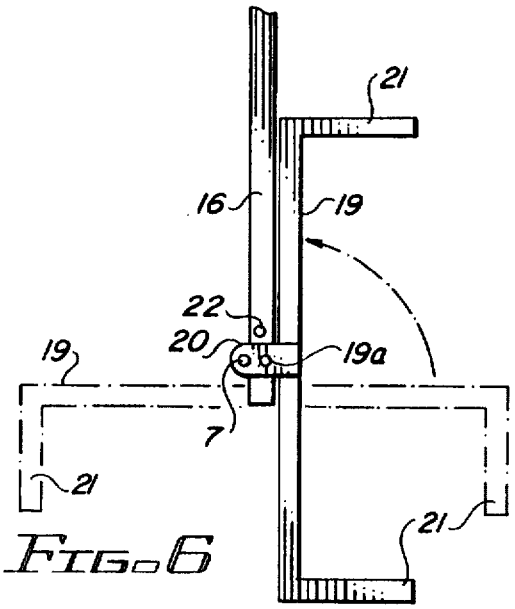
FIG. 6 is a side view of the lower portion of the frame support element of the bird throwing apparatus, more particularly illustrating selective positioning of the support foot into functional and folded configuration.
Figure 7:
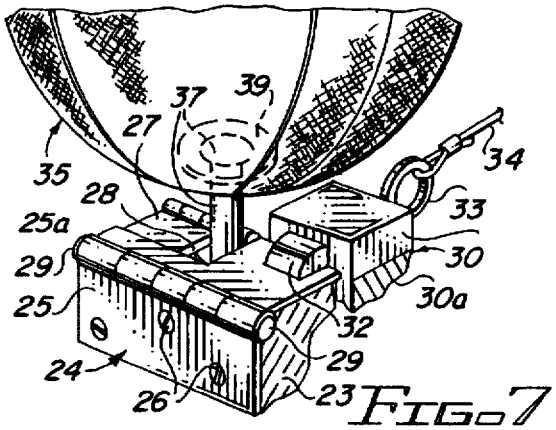
FIG. 7 is an enlarged perspective view of the lower end of the bird throwing apparatus illustrated in FIG. 1, more particularly detailing a preferred trigger mechanism in engaged or cocked configuration.
Figure 8B:
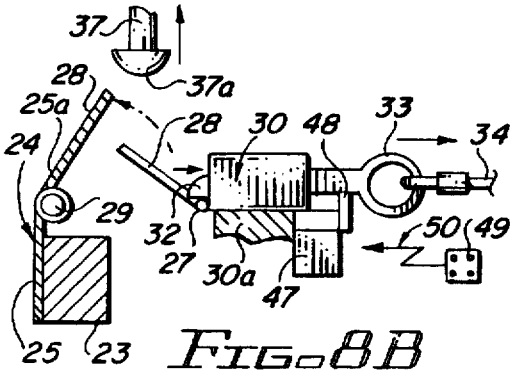
FIG. 8B is a side view, partially in section, of the trigger mechanism illustrated in FIGS. 7 and 8A, more particularly illustrating the trigger mechanism in release configuration.
Figure 8A:
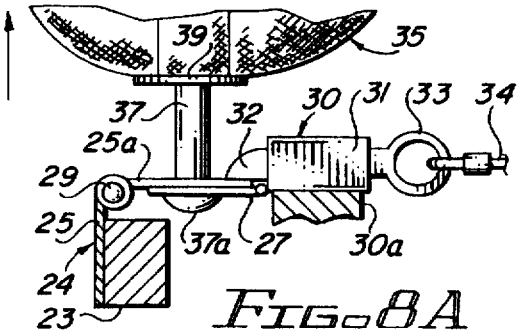
FIG. 8A is a side view, partially in section, of the trigger mechanism illustrated in FIG. 7 in the cocked configuration illustrated in FIGS. 1 and 7.

Referring now to FIGS. 3, 7, 8A and 8B of the drawings, the apparatus trigger mechanism operates to release the bird cradle 35 and throw a bird from the bird throwing apparatus 1, as follows: the bird cradle 35 is fitted with an engaging bolt 37 in the center thereof and is secured in that position by a pair of washers 39 and a nut 38, which engages the threaded end of the engaging bolt 37, as illustrated in FIG. 3. The engaging bolt 37 has a bolt head 37*a*, which is designed to releasably engage the trigger leaf slot 28 of a hinged and pivoting trigger leaf 27, mounted on the cradle trigger mount 30*a* opposite a release hinge 24, having a fixed leaf 25 and a pivoting leaf 25*a*, as illustrated in FIGS. 7 and 8*a*. When the surgical tubing 41 is tensioned by extending the tubing rings 40 downwardly and the surgical tubing 41 around the respective tubing pulleys 8 and engaging the tubing rings 40 with the tubing mount hooks 15 as heretofore described, tension is applied to the trigger leaf 27 and to the overlapping pivoting leaf 25*a* of the release hinge since the opposite fixed leaf 25 of the release hinge 24 is attached to the release mount 23 by means of recessed hinge mount screws 26. A conventional hinge pin 29 secures the pivoting leaf 25*a* of the release hinge 24 to the fixed leaf 25, as illustrated. The trigger housing 31 of a cradle trigger 30 is also mounted on the trigger mount 30*a*, which is welded or otherwise secured to the stiffening tubing 10 adjacent to the release hinge 24. The trigger housing 31 receives a slidably mounted engaging bar 32, which is spring-loaded inside the trigger housing 31 by means of a spring mechanism (not illustrated). The engaging bar 32 normally engages the pivoting leaf 25*a* of the release hinge 24 to maintain both the pivoting leaf 25*a* and the overlapped trigger leaf 27 in the cocked configuration illustrated in FIGS. 7 and 8A against the bias of the surgical tubing 41, which is exerted on the engaging bolt 37 when the engaging bolt 37 is inserted in the trigger leaf slot 28. The engaging bar 32 extends through the trigger housing 31 and terminates in a bar ring 33 on the end opposite the pivoting leaf 25*a* engaging end. A trigger cable 34 is attached to the bar ring 33 to facilitate selectively manually applying pressure to the engaging bar 32 and removing it from contact with the pivoting leaf 25*a*. Alternatively, a remote transmitter 49 can be used to energize a servo mechanism/receiver 47, mounted on the cradle trigger mount 30*a* and having a servo arm 48 connected to the bar ring 33, to retract the engaging bar 32 remotely by radio waves 50. Retraction of the engaging bar 32 from the pivoting leaf 25*a* facilitates release of the engaging bolt 37 from the trigger leaf slot 28 in the underlying hinged trigger leaf 27 and allows the bird cradle 35 to rapidly travel along the entire length of the stiffening tubing 10 to the release frame 2 as illustrated in FIG. 2 and catapult one or more dead ducks, dove, quail or other bird(s) from the bird cradle 35 into a selected trajectory determined by the angular mounting of the bird throwing apparatus 1 with respect to the ground, as illustrated in FIG. 1.

Referring now to FIG. 9 of the drawings, in another preferred embodiment of the invention a starter pistol 43 is attached to one of the stiffening tubing 10 by means of pistol straps 43*a* and one end of a pistol trigger lanyard 45 is attached to the pistol trigger 44 of the starter pistol 43, while the other end of the pistol trigger lanyard 45 is secured to a lanyard mount bolt 46, attached to the flexible bird cradle 35. Accordingly, when the bird cradle 35 is released as illustrated in FIG. 8B, upward movement of the bird cradle 35 applies tension to the pivot trigger lanyard 45 and causes the starter pistol 43 to fire, thereby simulating a shotgun firing to kill the bird or birds ejected from the bird throwing apparatus 1.

Figure 10:
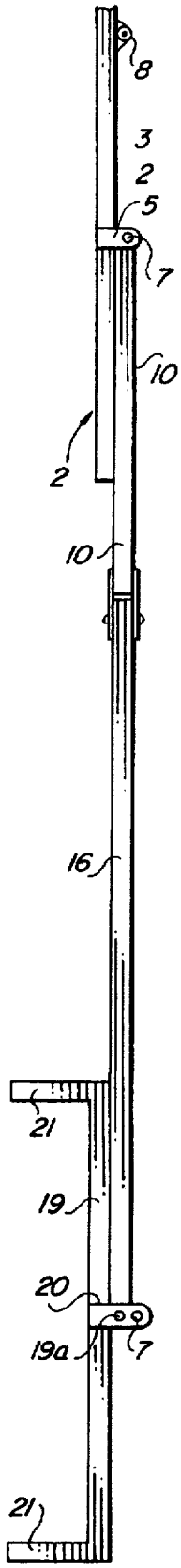
FIG. 10 is a front view of the bird throwing apparatus in folded configuration.

Referring again to FIG. 1 and to FIG. 10 of the drawing, it will be appreciated that the release frame 2, frame support 16 and support foot 19 components of the bird throwing apparatus 1 can be welded or otherwise fixed into position, instead of pivoting to a folded, stored or shipping configuration as illustrated in FIG. 10. For example, the release frame 2 can be welded to the ends of the stiffening tubing 10, thus eliminating the frame pivot brackets 5, the top end of the frame support 16 can, in turn, be welded to the corresponding stiffening tubing 10 at a desired angle with respect to the horizontal and the support foot 19 can be welded to the bottom end of the frame support 16, as desired. In such a configuration, the rigid bird throwing apparatus can be carried in a jeep, truck or other vehicle or pivotally mounted to the front end of the vehicle for use in the field as desired. Alternatively, the bird throwing apparatus 1 can be configured as illustrated in FIG. 10, thereby facilitating folding of the release frame 2 against the respective stiffening tubing 10, the frame support 16 against the corresponding stiffening tubing 10 to which it is attached and the support foot 19 against the frame support 16, as further illustrated in FIG. 10. This is accomplished by simply removing the respective bracket pins 12, as heretofore described.

It will be further appreciated that while the drawings illustrate use of square metal tubing such as aluminum tubing, round tubing or bar stock can also be used as desired. Furthermore, elastic bands of various description can be used in place of the surgical tubing 41, although the round surgical tubing is preferred, since it stretches around each tubing pulley 8 more readily. Moreover, the bird cradle 35 may be constructed of any desired flexible material such as plastic, rubber or the like. The trigger mechanism may also be designed differently from that illustrated in the drawings, according to the knowledge of those skilled in the art. The bird throwing apparatus can be transported, set up and operated, either manually or remotely, by one person and can be operated to toss as many as four large ducks or more in a single operational sequence.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A bird throwing apparatus for resting on a supporting surface, comprising a release frame; at least one pair of stiffening tubing, each of said pair of stiffening tubing having one end attached to said release frame and the opposite ends of said stiffening tubing converging from said release frame and at least one of said opposite ends of said stiffening tubing extending to engage the supporting surface; frame support means attached to at least one of said stiffening tubing for supporting said release frame and said stiffening tubing at a selected angle with respect to the supporting surface; elastic means having one end connected to said stiffening tubing for propelling a bird; pulley means carried by said release frame, for receiving said elastic means; cradle means for receiving a bird, with the opposite end of said elastic means connected to said cradle means; and trigger means provided at said opposite ends of said stiffening tubing from said one end for removably engaging said cradle means when said elastic means is tensioned and selectively releasing said cradle means to eject the bird from said cradle means responsive to release of tension in said elastic means.

2. The bird throwing apparatus of claim 1 comprising a firearm carried by said frame and a firing lanyard connecting said firearm to said cradle means, whereby travel of said cradle means with respect to said frame when said cradle means is released from said trigger means applies tension to said firing lanyard and operates said firearm for simulating shooting of the bird.

3. The bird throwing apparatus of claim 1 wherein said elastic means comprises at least two elastic bands, with one end of said elastic bands fixed to said cradle means and further comprising a ring attached to the opposite ends of said elastic bands and hooks provided on said frame for removably receiving said rings when said cradle means engages said trigger means.

4. The bird throwing apparatus of claim 3, comprising a firearm carried by said frame and a firing lanyard connecting said firearm to said cradle means, whereby travel of said cradle means with respect to said frame when said cradle means is released from said trigger means applies tension to said firing lanyard and operates said firearm for simulating shooting of the bird.

5. The bird throwing apparatus of claim 4 comprising a firearm carried by said frame and a firing lanyard connecting said firearm to said cradle means, whereby travel of said cradle means with respect to said frame when said cradle means is released from said trigger means applies tension to said firing lanyard and operates said firearm for simulating shooting of the bird.

6. The bird throwing apparatus of claim 1 wherein said trigger means comprises a hinge having a first hinge leaf and a second hinge leaf, with said first hinge leaf attached to said frame and said second hinge leaf pivotally mounted with respect to said first hinge leaf; a slot provided in said second hinge leaf and a bolt provided in said cradle means for engaging said slot; a trigger having a trigger housing mounted on said frame adjacent to said hinge, said trigger further comprising an engaging bar spring-loaded in slidably-extended configuration from said trigger housing for releasably engaging said second hinge leaf and maintaining said bolt in said slot; and a trigger cable attached to said engaging bar, whereby said cradle means is released from said hinge responsive to tension applied to said trigger cable, slidable retraction of said engaging bar into said trigger housing from said second hinge leaf, pivoting of said second hinged leaf with respect to said first hinged leaf and exiting of said bolt from said slot.

7. The bird throwing apparatus of claim 6 comprising a firearm carried by said frame and a firing lanyard connecting said firearm to said cradle means, whereby travel of said cradle means with respect to said frame when said cradle means is released from said second hinge leaf, applies tension on said firing lanyard and operates said firearm for simulating shooting of the bird.

8. The bird throwing apparatus of claim 6 wherein said release frame is removably attached to said at least one pair of stiffening tubing and said frame support means is pivotally attached to at least one of said stiffening tubing for supporting said release frame and said stiffening tubing at a selected angle with respect to the supporting surface.

9. The bird throwing apparatus of claim 8 wherein said elastic means comprises four lengths of surgical tubing, with one end of said surgical tubing fixed to said cradle means and further comprising a ring attached to the opposite ends of said surgical tubing and hooks provided on said stiffening tubing, for removably receiving said rings when said cradle means engages said trigger means.

10. A bird throwing apparatus for mounting on a supporting surface and throwing dead birds through a selected trajectory, comprising a release frame; at least one pair of stiffening tubing, each of said pair of stiffening tubing having one end attached to said release frame and the opposite ends of said stiffening tubing converging from said release frame; frame support means attached to at least one of said stiffening tubing for supporting said release frame and said stiffening tubing at a selected angle with respect to the supporting surface; a plurality of pulleys carried by said release frame; a plurality of elastic bands extending around said pulleys, with one end of each of said elastic bands means removably connected to said opposite ends of said stiffening tubing; a flexible bird cradle connected to the opposite ends of said elastic bands; and trigger means attached to said opposite ends of said stiffening tubing for releasably receiving said bird cradle, whereby said bird cradle is releasably connected to said trigger means and said elastic bands are tensioned around said pulleys to place said bird throwing apparatus in cocked configuration and said bird cradle is released from said trigger means and the birds are ejected from said bird cradle responsive to operation of said trigger means and the tension in said elastic bands.

11. The bird throwing apparatus of claim 10 comprising a firearm carried by said frame and a firing lanyard connecting said firearm to said bird cradle, whereby travel of said bird cradle with respect to said frame when said bird cradle is released from said trigger means applies tension on said firing lanyard and operates said firearm for simulating shooting of the bird.

12. The bird throwing apparatus of claim 10 wherein said release frame is removably attached to said stiffening tubing, and said frame support means is pivotally attached to said stiffening tubing for supporting said release frame and said stiffening tubing at a selected angle with respect to the supporting surface and comprising a pistol carried by said stiffening tubing and a firing lanyard connecting said pistol to said bird cradle, whereby travel of said bird cradle with respect to said frame when said bird cradle is released from said trigger means applies tension on said firing lanyard and operates said pistol for simulating shooting of the bird.

13. A bird throwing apparatus for mounting on a supporting surface and throwing dead birds through a selected trajectory to simulate shooting of the birds, said bird throwing apparatus comprising a frame having a discharge end and a trigger end; a support adjustably carried by said frame for adjusting the angle of said discharge end with respect to said supporting surface; four pulleys carried by said discharge end of said frame; four lengths of surgical tubing extending around said pulleys, with one end of each of said surgical tubing removably connected to said frame; a flexible bird cradle disposed in said frame for receiving the birds, with the opposite ends of said surgical tubing fixedly attached to said bird cradle; remotely-operated trigger means attached to said trigger end of said frame for releasably receiving said bird cradle; whereby said bird cradle is releasably connected to said trigger means and said surgical tubing are tensioned around said pulleys, with said opposite ends of said surgical tubing removably connected to said frame, to place said bird throwing apparatus in cocked configuration and said bird cradle is released from said trigger means and the birds are ejected from bird cradle responsive to operation of said trigger means and the tension in said surgical tubing; and firing means carried by said frame for simulating said shooting of the birds and a firing lanyard connecting said firing means to said bird cradle, whereby travel of said bird cradle with respect to said frame when said bird cradle is released from said trigger means applies tension on said firing lanyard and operates said firing means.

* * * * *